US010849195B2

(12) United States Patent
Fu et al.

(10) Patent No.: US 10,849,195 B2
(45) Date of Patent: Nov. 24, 2020

(54) DIMMER CONTROL CIRCUIT, METHOD AND SYSTEM

(71) Applicant: Delta Electronics, Inc., Taoyuan (CN)

(72) Inventors: Xiaoping Fu, Taoyuan (CN); Yugang Bao, Taoyuan (CN); Linwei Chen, Taoyuan (CN); Xinghua Zhang, Taoyuan (CN)

(73) Assignee: Delta Electronics, Inc., Taoyuan (CN)

( * ) Notice: Subject to any disclaimer, the term of this patent is extended or adjusted under 35 U.S.C. 154(b) by 0 days.

(21) Appl. No.: 16/354,285

(22) Filed: Mar. 15, 2019

(65) Prior Publication Data

US 2019/0297715 A1 Sep. 26, 2019

(30) Foreign Application Priority Data

Mar. 23, 2018 (CN) ..... 2018 1 0247972

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 45/10*** | (2020.01) |
| ***H05B 45/37*** | (2020.01) |

(52) U.S. Cl.

CPC ..... *H05B 39/045* (2013.01); *H05B 45/10* (2020.01); *H05B 45/37* (2020.01)

(58) Field of Classification Search

None

See application file for complete search history.

(56) References Cited

U.S. PATENT DOCUMENTS

| | | | | |
|---|---|---|---|---|
| 9,402,293 | B2 * | 7/2016 | Vaughan | H05B 33/0815 |
| 9,591,710 | B1 * | 3/2017 | Zheng | H05B 33/0845 |
| 2012/0098516 | A1 | 4/2012 | Snelten | |
| 2013/0106298 | A1 * | 5/2013 | Datta | H05B 33/0815 315/186 |
| 2013/0278159 | A1 | 10/2013 | Del Carmen, Jr. | |
| 2014/0285100 | A1 * | 9/2014 | Akahoshi | H05B 45/37 315/200 R |

(Continued)

FOREIGN PATENT DOCUMENTS

| | | |
|---|---|---|
| CN | 205249536 U | 5/2016 |
| CN | 103874285 B | 6/2017 |

(Continued)

OTHER PUBLICATIONS

The JP1OA issued Jan. 7, 2020 by the JPO.

*Primary Examiner* — Anh Q Tran

(74) *Attorney, Agent, or Firm* — Yunling Ren

(57) ABSTRACT

A dimmer control circuit for controlling a phase cut dimmer includes: a rectifier circuitry, configured to rectify the output voltage of the phase cut dimmer to output a rectified voltage; an input voltage detecting circuitry, configured to output a detected voltage according to the rectified voltage; a processor, configured to output a control signal when the detected voltage meets a preset condition; and a constant current circuitry, configured to output or stop outputting a preset current to the rectifier circuitry in response to the control signal; wherein the preset current has a value greater than a holding current of the phase cut dimmer.

16 Claims, 11 Drawing Sheets

(56) References Cited

U.S. PATENT DOCUMENTS

| | | | | |
|---|---|---|---|---|
| 2014/0320031 | A1* | 10/2014 | Wu | H05B 33/0812 315/193 |
| 2014/0333228 | A1* | 11/2014 | Angeles | H05B 33/0815 315/291 |
| 2015/0163873 | A1* | 6/2015 | Kawai | H05B 33/0815 315/127 |
| 2015/0256091 | A1 | 9/2015 | Melanson | |
| 2015/0319818 | A1* | 11/2015 | Kahlman | H05B 37/0209 315/201 |
| 2015/0366019 | A1* | 12/2015 | Kuang | H05B 33/0815 315/206 |
| 2016/0113077 | A1* | 4/2016 | Akiyama | H05B 33/0815 315/201 |
| 2016/0135257 | A1* | 5/2016 | Gaknoki | H05B 33/08 315/309 |
| 2018/0184490 | A1* | 6/2018 | Ido | H05B 33/0824 |

FOREIGN PATENT DOCUMENTS

| | | | |
|---|---|---|---|
| EP | 3026988 | A1 | 6/2016 |
| GB | 2514929 | A | 12/2014 |
| JP | 2012085486 | A | 4/2012 |
| JP | 2012531651 | A | 12/2012 |
| JP | 2014186871 | A | 10/2014 |

* cited by examiner

DIMMER CONTROL CIRCUIT, METHOD AND SYSTEM

CROSS REFERENCE

This application is based upon and claims priority to Chinese Patent Application No. 201810247972.9, filed on Mar. 23, 2018, the entire contents thereof are incorporated herein by reference.

TECHNICAL FIELD

The present disclosure relates to the field of power circuit technologies, and more particularly, to a control circuit, method and system compatible to a phase cut dimmer.

BACKGROUND

With the development of LED technology, the compatible phase cut dimmer control circuit used in the field of illumination has also been improved. In order for the LED power to work with a phase cut dimmer, it is necessary to ensure that the working current of the LED power is greater than the holding current of the dimmer.

FIG. 1 is a circuit diagram of a compatible phase cut dimmer control circuit in the related art. Referring to FIG. 1, a full-wave voltage is obtained by the AC input which is rectified by diodes D1 and D2. The full-wave voltage is transmitted to the gate of the field effect transistor (FET) Q1 through the resistor R3, and grounded by passing through the resistor R1, the FET Q1 and the resistor R2, and then returns to the AC input terminal through the bridge rectifier DB 1 to form a loop. When the holding current flows through the resistor R2, a voltage drop across R2 occurs. When the voltage drop reaches to the Vbe threshold level of the transistor Q2, the transistor Q2 starts to turn on and accordingly the gate voltage of the FET Q1 drops to the certain threshold level where Q2 operates in linear mode. The current through Q2 and R2, which provides stable holding current to the dimmer, and keeps at a stable constant condition thanks to the closed feedback control loop of R1, Q1 and Q2.

However, the full-wave voltage is divided by the sample resistors R4 and R5, and the sample resistor R5 is respectively coupled to the base and the emitter of the transistor Q2. When the voltage on the R5 reaches the threshold voltage of the transistor Q2, the transistor Q2 is turned on and the FET Q1 is turned off. So when the full-wave voltage is in its higher level range, for example, when the turn-on voltage of the dimmer is higher than the set voltage, the FET Q1 remains being turned off, and there will be no current in the loop. A large transient voltage is generated at the point when the dimmer is turned on, and the input current will generate a ringing. The ringing makes the minimum current to be less than the minimum holding current of the dimmer, which causes the dimmer to be turned off immediately after being turned on and makes the output LED lamp flicker.

It should be noted that the information disclosed in the Background section above is only for enhancing the understanding of the background of the present disclosure, and thus may include information that does not constitute prior art known to those of ordinary skill in the related art.

SUMMARY

An objective of the present disclosure is to provide a dimmer control circuit, method and system capable of providing compensation current to a phase cut dimmer, so as to overcome the flickering problem of the light source during turning-on of the dimmer in the related art.

According to an aspect of the present disclosure, there is provided a dimmer control circuit for controlling a phase cut dimmer, including: a rectifier circuitry, coupled to an output terminal of the dimmer and configured to rectify the output voltage of the dimmer to output a rectified voltage; an input voltage detecting circuitry, provided with an input terminal coupled to the rectifier circuitry, and configured to output a detected voltage according to the rectified voltage; a processor, provided with an input terminal coupled to an output terminal of the input voltage detecting circuitry, and configured to output a control signal when the detected voltage meets a preset condition; and a constant current circuitry, provided with a control terminal coupled to an output terminal of the processor and an output terminal coupled to the rectifier circuitry, and configured to output or stop outputting a preset current to the rectifier circuitry in response to the control signal; wherein the preset current has a value greater than a holding current of the dimmer.

According to the second aspect of the present disclosure, a current control method of a phase cut dimmer includes: detecting an output voltage of the dimmer according to a preset period; providing compensation current to the dimmer when the output voltage of the dimmer meets a preset condition, the compensation current compensating a holding current of the dimmer; and stopping the providing of the compensation current when the output voltage of the dimmer does not meet the preset condition.

According to the third aspect of the present disclosure, a current control system includes: an AC power, provided with a first output terminal and a second output terminal; a phase cut dimmer, provided with one terminal coupled to a first output terminal of the AC power, and another terminal coupled to a voltage output node; a bridge rectifier diode, provided with a cathode coupled to the voltage output node, and an anode grounded; an illumination power circuit, provided with a first input terminal, a second input terminal, a first output terminal, and a second output terminal, wherein the first input terminal is coupled to the voltage output node; an illumination module, provided with at least one light source coupled to the first output terminal and the second output terminal of the illumination power circuit; and a dimmer control circuit, coupled between the voltage output node and the ground for providing compensation current to the dimmer when an output voltage of the dimmer meets a preset condition, and stopping the providing of the compensation current when the output voltage of the dimmer does not meet the preset condition.

It should be understood that the above general description and the detailed description below are merely exemplary and explanatory, and do not limit the present disclosure.

BRIEF DESCRIPTION OF THE DRAWINGS

The accompanying drawings herein, which are incorporated in and constitute a part of this specification, illustrate embodiments consistent with the present disclosure and, together with the description, serve to explain the principles of the present disclosure. Apparently, the accompanying drawings in the following description show merely some embodiments of the present disclosure, and persons of ordinary skill in the art may still derive other drawings from these accompanying drawings without creative efforts.

DETAILED DESCRIPTION

Figure 1:
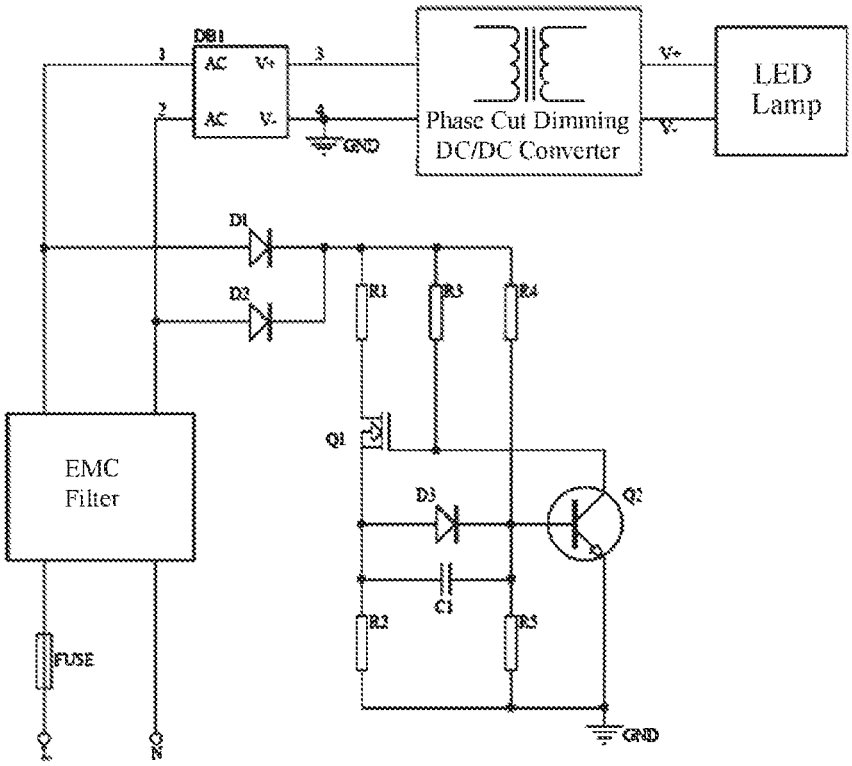
FIG. 1 schematically illustrates a circuit diagram of dimmer control circuit in the related art.

The exemplary embodiments will now be described more fully with reference to the accompanying drawings. However, the exemplary embodiments can be implemented in a variety of forms and should not be construed as limited to the embodiments set forth herein. Rather, the embodiments are provided so that the present disclosure will be thorough and complete and will fully convey the concepts of exemplary embodiments to those skilled in the art. The features, structures, or characteristics described may be combined in one or more embodiments in any suitable manner. In the following description, numerous specific details are provided to give a full understanding of the embodiments of the present disclosure. Those skilled in the art will recognize, however, that the technical solution of the present disclosure may be practiced without one or more of the specific details described, or that other methods, components, materials, etc. may be employed. In other instances, well-known technical solutions are not shown or described in detail to avoid obscuring aspects of the present disclosure.

In addition, the accompanying drawings are merely exemplary illustration of the present disclosure, and are not necessarily drawn to scale. The same reference numerals in the drawings denote the same or similar parts, and thus repeated description thereof will be omitted. Some block diagrams shown in the figures are functional entities and not necessarily to be corresponding to a physically or logically individual entities. These functional entities may be implemented in software form, or implemented in one or more hardware modules or integrated circuits, or implemented in different networks and/or processor apparatuses and/or microcontroller apparatuses.

The exemplary embodiments of the present disclosure are described in detail below with reference to the accompanying drawings.

Figure 2:
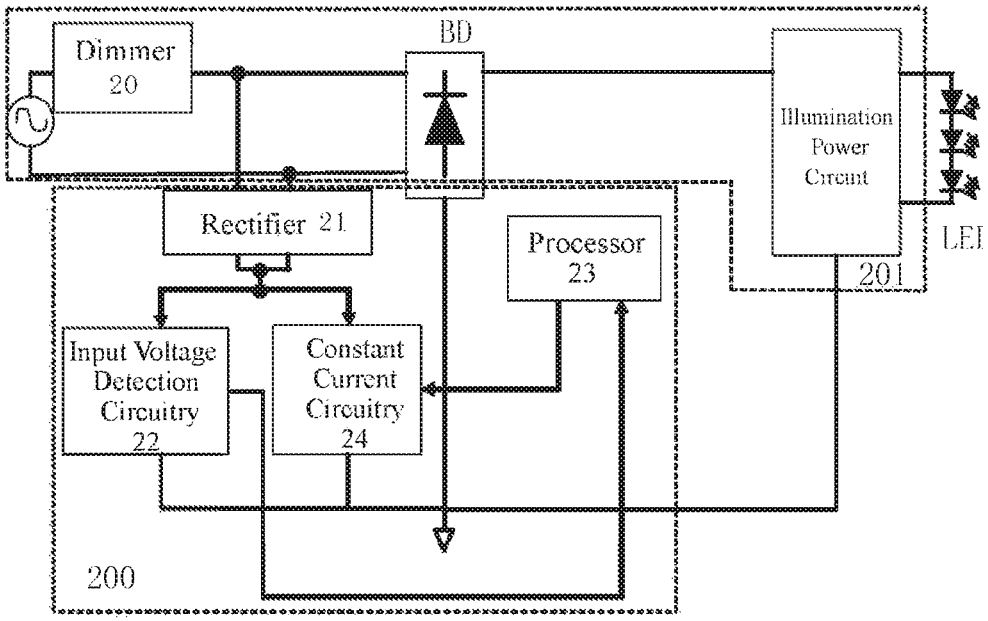
FIG. 2 is a schematic diagram illustrating an LED dimming system in an embodiment of the present disclosure.

Referring to FIG. 2, the LED dimming system includes a dimming power circuit 201 and a dimmer control circuit 200. The dimmer power circuit 201 includes a phase cut dimmer 20 for supplying power to a LED lamp and adjusting the brightness of the LED lamp according to the dimmer 20. The dimmer control circuit 200 is connected to the dimming power circuit 201 for providing compensation current to the dimmer 20 when the output voltage of the dimmer 20 meets a preset condition.

Figure 3:
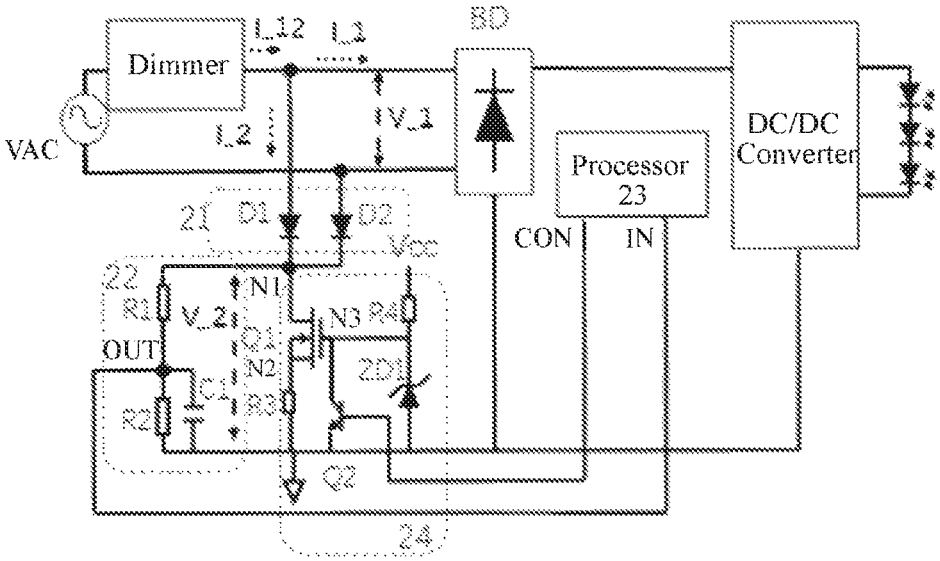
FIG. 3 is a schematic diagram illustrating an LED dimming system in another embodiment of the present disclosure.

In an embodiment of the present disclosure, the dimming power circuit 201 includes the AC power VAC, the dimmer 20, the bridge rectifier circuit BD, the illumination power circuit. In an embodiment, the AC power includes a first output terminal and a second output terminal; the dimmer 20 is coupled to the first output terminal of the AC power VAC; the bridge rectifier circuit BD includes a cathode coupled to the output terminal of the dimmer 20, and an anode grounded. The illumination power circuit is coupled to the output terminal of the dimmer 20, and its output terminal is connected to the LED string light. In an exemplary embodiment of the present disclosure, the illumination power circuit includes a DC-DC converter (e.g., as shown in FIG. 3), but not limited thereto.

In an embodiment of the present disclosure, the dimmer control circuit 200 includes the rectifier circuitry 21, the input voltage detecting circuitry 22, the processor 23, and the constant current circuitry 24. The dimmer control circuit 200 is configured to provide compensation current to the dimmer 20 when the output voltage of the dimmer meets a preset condition and stop the supply of the compensation current when the output voltage of the dimmer does not meet the preset condition. In an exemplary embodiment of the present disclosure, the preset condition includes that the changing speed of the detection voltage of the dimmer is greater than a first preset value or the output voltage value thereof is smaller than a second preset value.

In an embodiment, the rectifier circuit 21 is coupled to an output terminal of the dimmer for rectifier the output voltage of the dimmer 20 and outputting a rectified voltage. The input terminal of the input voltage detecting circuit 22 is coupled to the rectifier circuit 21 for outputting a detecting voltage according to the rectified voltage. The input terminal of the processor 23 is coupled to the output terminal of the input voltage detecting circuit 22 for outputting a control signal when the detected voltage meets a preset condition. The control terminal of the constant current circuitry 24 is coupled to the output terminal of the processor 23 and the output terminal thereof is coupled to the rectifier circuit 21 for outputting or stopping outputting a preset current to the rectifier circuit 21 in response to the control signal.

In an embodiment, the current value of the preset current is greater than the holding current of the dimmer.

In an exemplary embodiment of the present disclosure, the dimmer is a leading-edge cut dimmer or a trailing-edge cut dimmer.

The dimmer control circuit provided by the embodiment of the present disclosure provides compensation current for the dimmer which is greater than the holding current thereof when the output voltage of the dimmer change abnormally, and avoids the disconnection of the dimmer caused by oscillating current generated from the process that the dimmer switch from an off state to an on state, and prevents the light source flicker when the dimmer is turned on.

Referring to FIG. 3, in an exemplary embodiment of the present disclosure, the rectifier circuit 21 includes the first diode D1 and the second diode D2. The anode of the first diode D1 is coupled to the first terminal of the output terminal of the dimmer, and the cathode thereof is coupled to the first node N1. The anode of the second diode D2 is coupled to the second terminal of the output terminal of the dimmer, and the electrode thereof is coupled to the first node N1. The rectifier circuit rectifies the output voltage V1 of the dimmer 20 to obtain a rectified voltage $V_{N1}$.

The input voltage detecting circuit 22 includes the first resistor R1 and the second resistor R2. One terminal of the first resistor R1 is coupled to the first node N1, and the other terminal thereof is coupled to an output terminal OUT of the input voltage detecting circuit 22. One terminal of the second resistor R2 is coupled to the output terminal OUT and the other terminal thereof is grounded. The input voltage detecting circuit 22 can set the ratio of R1 and R2 to make the rectified voltage VN1 decrease proportionally to obtain a detection voltage V2 that can be transmitted to the processor 23. Herein, $$V2=a*VN1 \quad (1)$$

wherein a is the detection coefficient of the input voltage detecting circuit 22.

In some embodiments, the input voltage detection circuit 22 can also include a filter capacitor C1 between the output terminal OUT and ground.

It is noted that the input voltage detecting circuit in FIG. 3 is only shown as an embodiment, as the components and connections of the input voltage detecting circuit can be conceived by those skilled in the art according to principle of the embodiment.

The constant current circuitry 24 includes a first switching device Q1, a third resistor R3, a second switching device Q2, a fourth resistor R4 and a zener diode ZD1. The first switching device Q1 includes a first terminal, a second terminal, and a control terminal, the first terminal is coupled to the first node N1, the second terminal is coupled to a second node N2, and the control terminal is coupled to a third node N3. One terminal of the third resistor R3 is coupled to the second node N2, and the other terminal thereof is grounded. The second switching device Q2 includes a first terminal, a second terminal, and a control terminal, the first terminal is coupled to the third node N3, the second terminal is grounded, and the control terminal is coupled to the output terminal CON of the processor 23. One terminal of the fourth resistor R4 is coupled to the DC voltage source VCC, and the other terminal thereof is coupled to the third node N3. The zener diode ZD1 includes a cathode coupled to the third node N3 and an anode grounded.

The DC voltage source Vcc generates a stable voltage Vg through R4 and ZD1 to the gate of Q1 so that Q1 can be turned on, and the current flows through R3 to generate a voltage V_R3. When value of the voltage V_R3 increases to be greater than Vg-Vth (Vth is the turn-on threshold voltage of Q1), Q1 is turned off and the current of R3 becomes smaller, and then value of the voltage V_R3 decreases. When value of the voltage V_R3 is less than Vg-Vth, Q1 turns on again. Finally, the value of the voltage V_R3 can equal to Vg-Vth and Q1 can operate in the intermediate state of conduction and cutoff, so that the current flowing through Q1 is a constant value. Therefore, the constant current circuitry 24 can provide a constant current I as a compensation current to the dimmer for compensating the current of the dimmer. In an embodiment, the constant current I satisfies the following formula.

$$I=(Vg-Vth)/R3 \quad (2)$$

In one embodiment, the turn-on and turn-off state of the constant current circuitry 24 can be controlled by Q2. When Q2 is turned on, Vg becomes small, Q1 remains being turned off, and the constant current circuitry 24 does not output the constant current I; when Q2 is turned off, Vg increases, Q1 can be turned on or turned off, and the constant current circuitry 24 outputs the constant current I.

In the embodiment shown in FIG. 3, the input terminal IN of the processor 23 is coupled to the output terminal OUT of the input voltage detecting circuit 22, and the output terminal CON is coupled to the control terminal of the second switching device Q2. The output voltage V2 of the input voltage detecting circuit 22 controls the turn-on and turn-off of the second switching device Q2, thereby controlling whether the constant current circuitry 24 outputs the constant current I.

Figure 4:
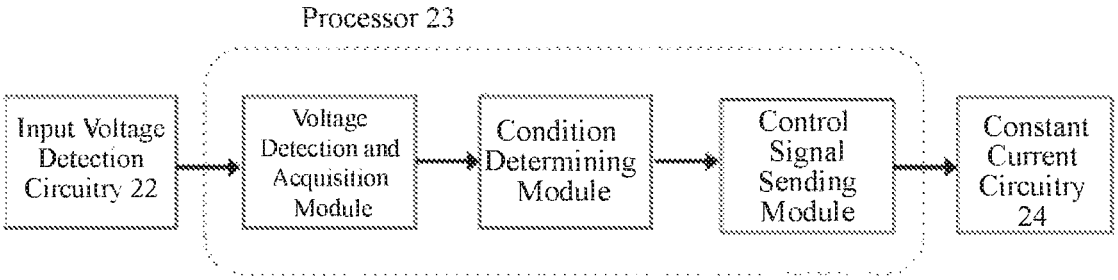
FIG. 4 schematically illustrates the processor in an embodiment of the present disclosure.

Referring to FIG. 4, in an exemplary embodiment of the present disclosure, a processor 23 includes a voltage detection and acquisition module, a condition determining module and a control signal sending module. The voltage detection and acquisition module is configured to acquire the detection voltage according to a preset period. The condition determining module is configured to determine whether the detected voltage meets the preset condition. The control signal sending module is configured to send a first control signal when the detection voltage meets the preset condition, and send a second control signal when the detection voltage does not meet the preset condition. In an embodiment, the first control signal and the second control signal are respectively used to control the turn-off and turn-on of the second switching device Q2.

The preset condition includes that the changing speed of the detection voltage of the dimmer is greater than a first preset value or the output voltage value thereof is smaller than a second preset value. At this time, the constant current circuitry outputs a constant current I according to the first control signal, and stops outputting the constant current I according to the second control signal.

The processor 23 may be, for example, a central processing unit, a single-chip microcomputer, or other programmable control device. The above-mentioned module may be a logic module or a physical circuit module as long as the function can be implemented. There is no limit to this disclosure.

The phase cut dimmer of the embodiment of the present disclosure may be a leading-edge cut dimmer or a trailing-edge cut dimmer. The control of the processor 23 will be described below from the perspective of the two dimmers, respectively, through FIGS. 5-9.

Figure 5:
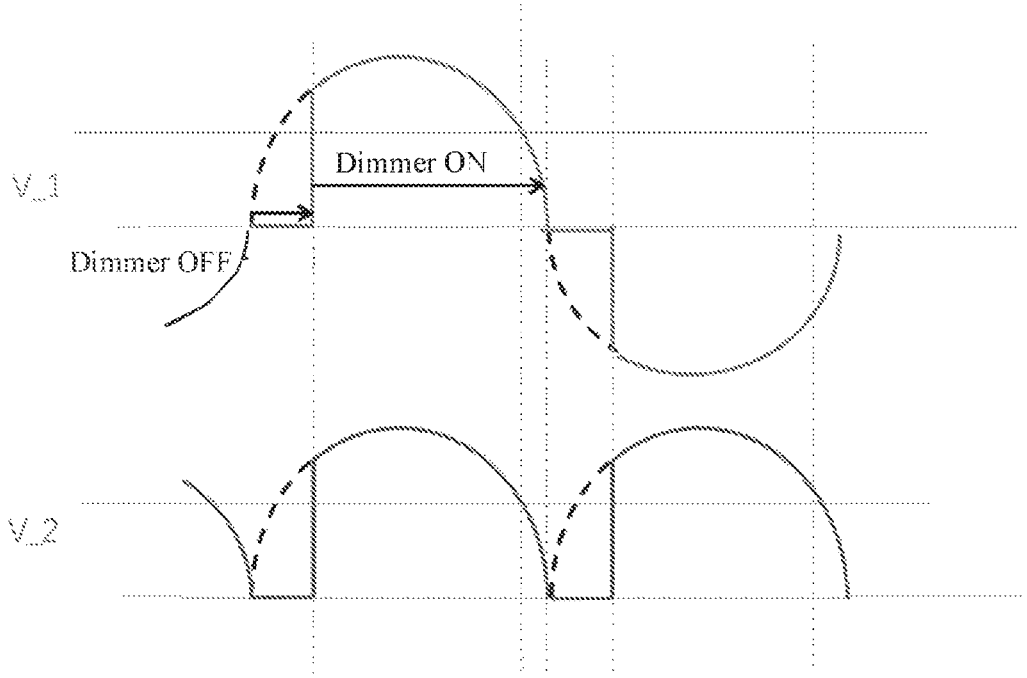
FIG. 5-FIG. 7 are schematic diagrams illustrating the dimmer control circuit applying to a leading-edge cut dimmer in an embodiment of the present disclosure.

FIG. 5 is a schematic diagram illustrating the principle applied to a leading-edge cut dimmer according to an embodiment of the present disclosure.

Referring to FIG. 5, when the leading-edge cut dimmer is turned off, the output voltage V1 of the dimmer 20 equals to 0 and the detection voltage V2 equals to 0, while when the leading-edge cut dimmer is turned on, the output voltage V1 of the dimmer 20 equals to the AC power Vac and the detection voltage V2 is proportional to the output voltage V1. The leading-edge cut dimmer transmits the dimming signal to the illumination power circuit by adjusting the turn-on and turn-off times of the dimmer 20, and the illumination power circuit adjusts the output current to realize dimming according to the dimming signal.

When the leading-edge cut dimmer is switched from an off state to an on state, a sudden change of voltage causes a large changing speed of the voltage. Due to the input capacitance of the illumination power circuit, a relatively high peak current is generated at the turn-on instant. This peak current has oscillation, and the minimum value of the oscillation may be smaller than the holding current required for the leading-edge cut dimmer to be turned on, thereby causing the turn-off of the leading-edge cut dimmer. In order to maintain the conduction of the leading-edge cut dimmer, the embodiment of the present disclosure adds a compensation current for the holding current to maintain the conduction of the leading-edge cut dimmer.

In the present disclosure, the constant current circuitry 24 provides the compensation current and the processor 23 controls the turn-on and turn-off of the constant current circuitry 24 to control the output and stopping output of the compensation current. In an embodiment, the processor 23 controls the constant current circuitry 24 to output a compensation current at a preset time tset by determining whether the changing speed d(V2)/dt of the detection voltage V2 is greater than the first preset value Vref1.

Figure 6:
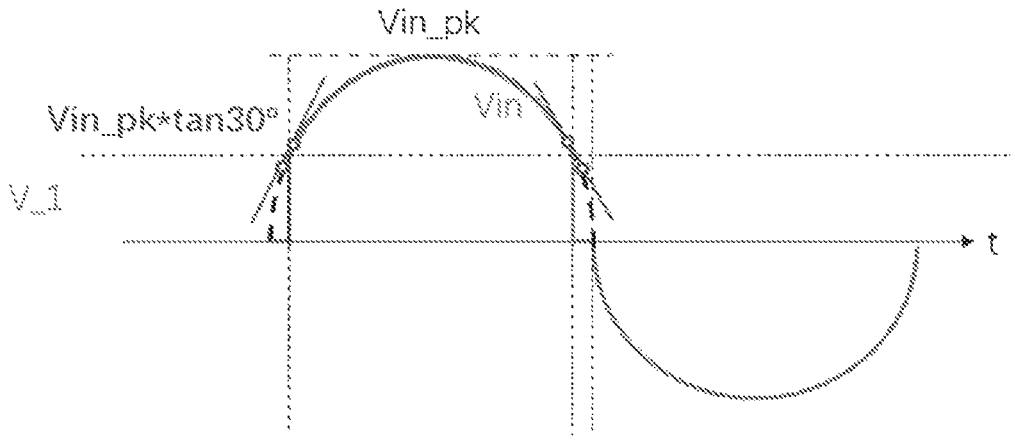

The first preset value Vref1 can be, for example, as shown in FIG. 6, and the sine waveform of the output voltage V1 of the dimmer 20 is tangent at an angle of 30°, as shown in the following formula (3).

$$V\text{ref1}=V1_pk*\tan 30°*a \quad (3)$$

V1_pk is the peak value of the output voltage of the dimmer, and a is the detection coefficient of the input voltage detecting circuit 22.

In addition, when the Vac is small, the current flowing through the leading-edge cut dimmer will also become small. When this current is less than the holding current of leading-edge cut dimmer, the leading-edge cut dimmer will be turned off. Therefore, in another embodiment of the present disclosure, the processor 23 controls the constant current circuitry 24 to output a compensation current by determining whether the detection voltage V2 is lower than the second predetermined value Vref2. In an embodiment, the value of the second preset value Vref2 may include, but is not limited to:

$$V\text{ref2}=V\min*a \quad (4)$$

In an embodiment. Vmin is the minimum input voltage and can be any voltage value between ¼ and ½ of V1_pk.

Figure 7:
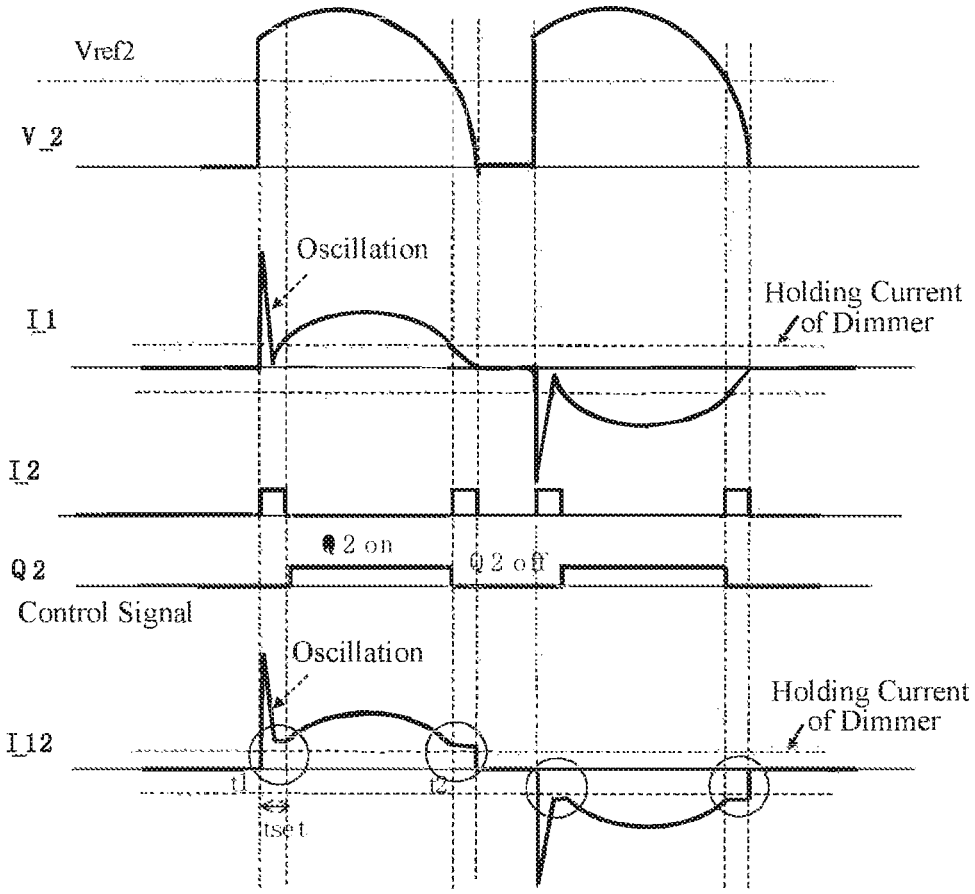

Referring to FIG. 7, for the leading-edge cut dimmer output voltage V1, the current I_1 is oscillated during switching from an off state to an on state, such as time t1. At this time, the processor 23 determines that dV2/dt is greater than the first preset value Vref1 by judging the detection voltage V2, and output the Q2 control signal at the preset time tset to control the Q2 to be turned off. Thereby the constant current circuitry 24 is controlled to output the compensation current I_2, wherein the value of I_2 needs to be greater than or equal to the holding current of the leading-edge cut dimmer. According to the node current law, the current I_12 flowing through the leading-edge cut dimmer is the sum of I_1 and I_2. Thus, the current I_12 flowing through the leading-edge cut dimmer is necessarily greater than the holding current of the leading-edge cut dimmer at the turn-on instant t1, so that the leading-edge cut dimmer is maintained in a conducting state. In addition, as shown in FIG. 7, when the detection voltage V2 is smaller than the second preset value Vref2, such as the time t2, the current I_1 is sufficiently low, it is difficult to maintain the conduction of the leading-edge cut dimmer, and at this time, Q2 is controlled to be turned off, and the constant current circuitry is controlled to output a compensation current I_2, wherein the value of I_2 needs to be greater than or equal to the holding current of the leading-edge cut dimmer. Thus, the current I_12 flowing through the leading-edge cut dimmer is greater than the holding current of the leading-edge cut dimmer, so that the leading-edge cut dimmer is maintained in a conducting state. According to the above embodiment, the leading-edge cut dimmer can be maintained in a conducting state in various states, so that the on-and-off time of the leading-edge cut dimmer can be correctly transmitted to the illumination power circuit, thereby can effectively avoid the light source flicker caused by the leading-edge cut dimmer turned on and then turned off.

Figure 8:
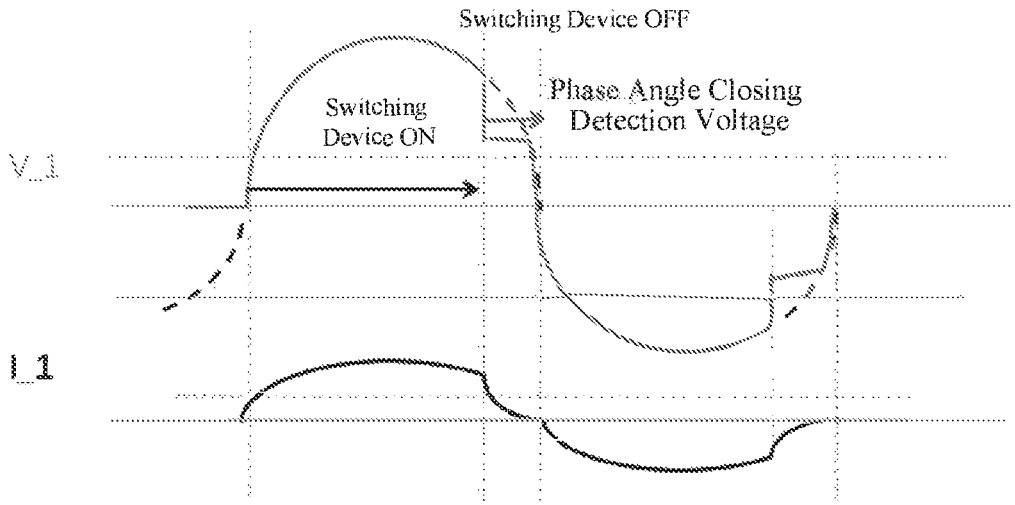
FIG. 8 is a schematic diagram illustrating the working principle of a trailing-edge cut dimmer.

FIG. 8 is a schematic diagram illustrating the working principle of a trailing-edge cut dimmer.

Referring to FIG. 8, the trailing-edge cut dimmer generally controls the open and close of the phase angle with a switching device such as a transistor. Since the trailing-edge cut dimmer contains a storage capacitor for the controller to operate or the switching device to maintain operation, when the switching device is turned from an on state to an off state, the voltage V1 cannot be effectively discharged to 0 due to internal capacitance, and is higher than the detection voltage of turning off the phase angle, which cause the cut phase angle to not be detected effectively and result in a dimming signal error.

Figure 9:
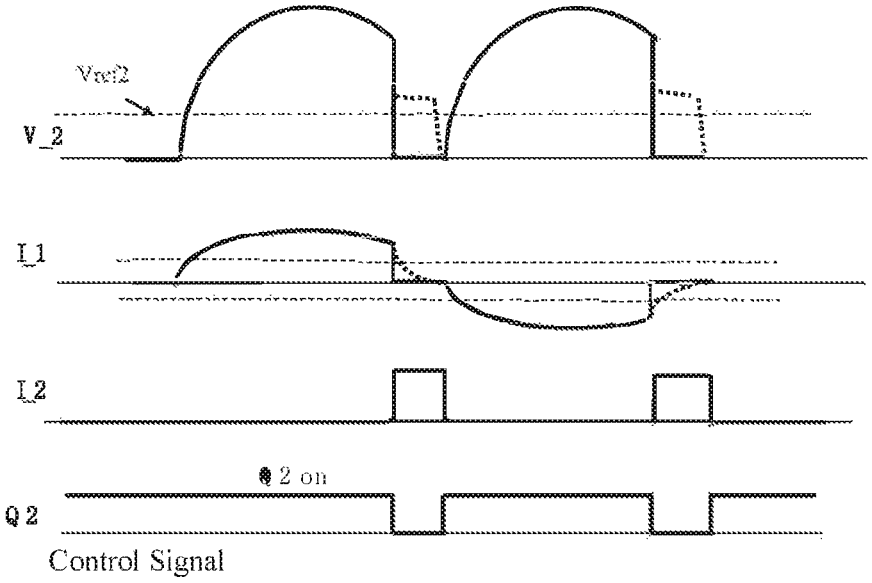
FIG. 9 is a schematic diagram illustrating a dimmer control circuit on a trailing-edge cut dimmer in an embodiment of the present disclosure.

FIG. 9 is a schematic diagram illustrating a dimmer control circuit on a trailing-edge cut dimmer in an embodiment of the present disclosure.

Referring to FIG. 9, in an exemplary embodiment of the present disclosure, when the processor 23 determines that the detection voltage V2 is smaller than the second preset value Vref2, Q2 is controlled to be turned from an on state to an off state so that the constant current circuitry 24 generates a preset value of the constant current I_2, and the current stored in the capacitor of the trailing-edge cut dimmer is discharged so that the voltage V1 to rapidly drop to zero for ensuring accurate detection of the phase-cut angle signal thereby.

Figure 10:
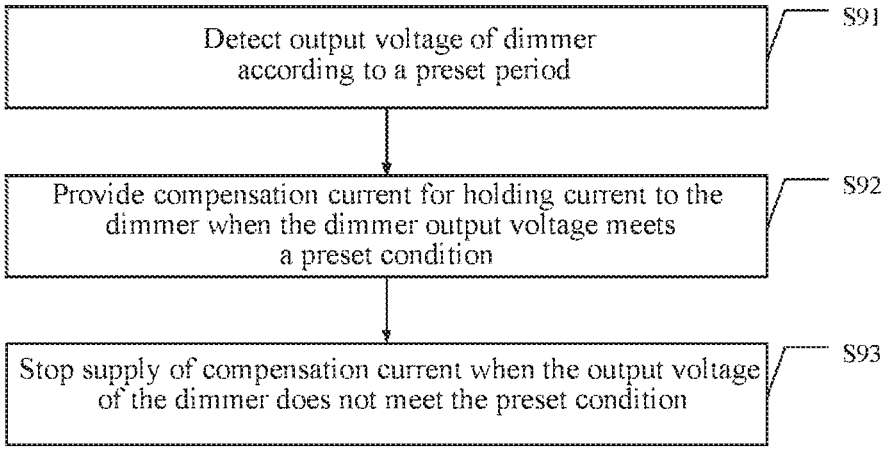
FIG. 10 is a schematic diagram illustrating a dimmer control method in an embodiment of the present disclosure.

FIG. 10 is a schematic diagram illustrating a dimmer control method in an embodiment of the present disclosure.

Referring to FIG. 10, a dimmer holding current control method includes steps S91-S93.

In step S91, the output voltage of the dimmer is detected according to a preset period;

In step S92, compensation current is provided for holding current to the dimmer when the dimmer output voltage meets a preset condition;

In step S93, the supply of the compensation current is stopped when the output voltage of the dimmer does not meet the preset condition.

In an exemplary embodiment of the present disclosure, the preset condition includes that the changing speed of the detection voltage is greater than a first preset value.

In another exemplary embodiment of the present disclosure, the preset condition includes that the output voltage value of the dimmer is smaller than a second preset value.

In an exemplary embodiment of the present disclosure, the compensation current is a constant current, and the constant current is greater than the holding current.

The dimmer control method 900 can be applied to the processor 23 of the dimmer control circuit 200.

Figure 11:
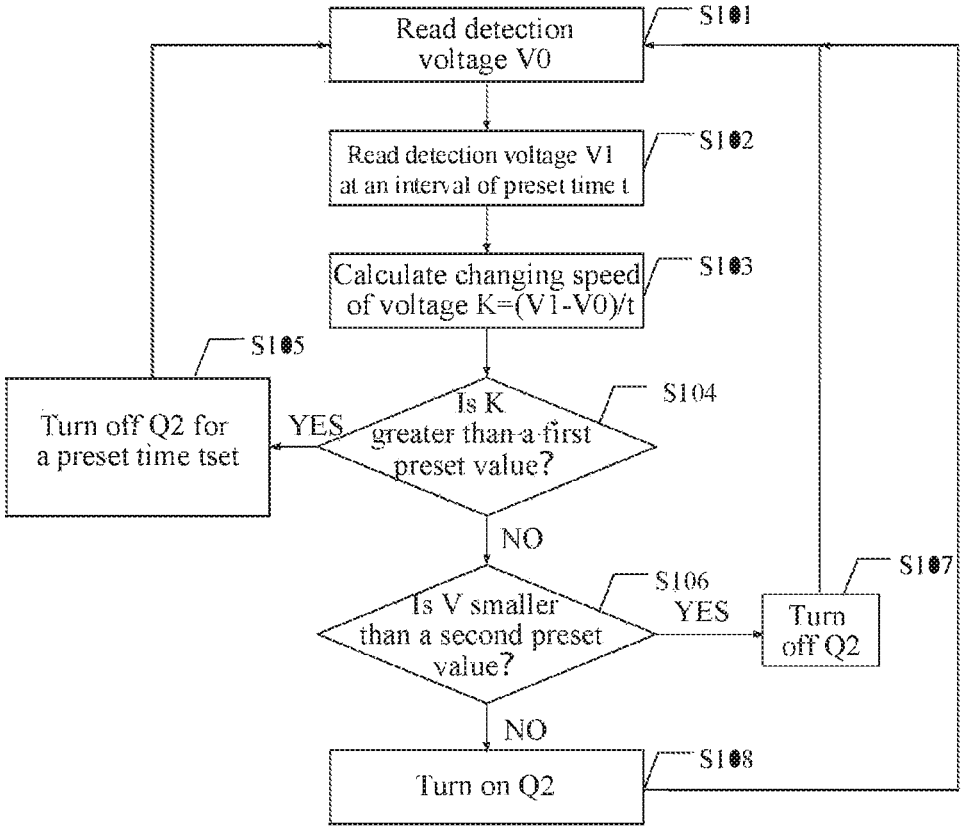
FIG. 11 is a schematic diagram illustrating a dimmer control method in an embodiment of the present disclosure.

FIG. 11 is an embodiment illustrating the dimmer control method 900.

Referring to FIG. 11, in an embodiment of the present disclosure, the dimmer control method exemplary includes steps S101-S107.

In step S101, the detection voltage is read and marked as V0.

In step S102, the detection voltage is read again at an interval of preset time t and marked as V1.

In step S103, the changing speed of the voltage K=(V1−V0)/t is calculated.

In step S104, it is determined whether the K is greater than the first preset value and, if yes, the process goes to the step S105. Otherwise, the process goes to the step S106.

In step S105, Q2 is turned off for the preset time tset so that the compensation current is supplied to the dimmer within the preset time. After the preset time tset is over, Q2 is turned on, and the process returns to the step S101 to read the detection voltage, wherein the current value of the compensation current is greater than or equal to the holding current of the dimmer.

In step S106, it is determined whether the current detection voltage V1 is smaller than the second preset value. If yes, the process goes to the step S107, Q2 is turned off, the compensation current is output to the dimmer, and the process returns to the step S101. Otherwise, the process returns to the step S108, Q2 is turned on, the compensation current is stopped outputting, and the process returns to the step S101.

It should be noted that, in other embodiments of the present disclosure, the sequence of step S104 and step S106 may also be reversed, but only if K is not greater than the first preset value and V1 is not less than the second preset value, the process goes to the step S108, Q2 is controlled to be turned on, thereby the constant current circuitry 24 is controlled to stop outputting the compensation current.

Further, the above-described behavior of returning to the step S101 from the step S105, the step S107, or the step S108 to continue to read the detection voltage may occur at time t after reading V1 (the judgment flow time T<<t). At this time, the read detection voltage V2 will calculate the voltage changing speed K together with V1, and determine whether V2 is greater than the first preset value and is smaller than the second preset value. The detection sequence and the time condition can be set by a person skilled in the art, and the disclosure does not specifically limit this.

It will be understood by those skilled in the art that aspects of the present disclosure may be embodied in the form of a complete hardware implementation, a complete software implementation (including firmware, microcode, etc.), or a combination of hardware and software which may be collectively referred as "circuit(s)", "circuitry(s)", "module(s)", or "system(s)" herein.

Further, the above-described drawings are merely illustrative of the processes included in the method according to the exemplary embodiments of the present invention, and are not intended to be limited. It is easy to understand that the processing shown in the above figures does not indicate or limit the time sequence of these processes. In addition, it is also easy to understand that these processes may be performed synchronously or asynchronously, for example, in a plurality of modules.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within prior art. It is intended that the specification and embodiments be considered as exemplary only, with a scope of the present disclosure being indicated by the following claims.

What is claimed is:

1. A dimmer control circuit for controlling a phase cut dimmer comprising:

a rectifier circuitry, coupled to an output terminal of the phase cut dimmer and configured to rectify the output voltage of the phase cut dimmer to output a rectified voltage;

an input voltage detecting circuitry, provided with an input terminal coupled to the rectifier circuitry, and configured to output a detected voltage according to the rectified voltage;

a processor, provided with an input terminal coupled to an output terminal of the input voltage detecting circuitry, and configured to output a control signal when the detected voltage meets a preset condition; and a constant current circuitry, provided with a control terminal coupled to an output terminal of the processor and an output terminal coupled to the rectifier circuitry, and configured to output or stop outputting a preset current to the rectifier circuitry in response to the control signal;

wherein the preset current has a value greater than a holding current of the phase cut dimmer, wherein the rectifier circuitry comprises:

a first diode, provided with an anode coupled to a first terminal of the output terminal of the phase cut dimmer, and a cathode coupled to a first node; and a second diode, provided with an anode coupled to a second terminal of the output terminal of the phase cut dimmer, and a cathode coupled to the first node, and wherein the constant current circuitry comprises:

a first switching device provided with a first terminal, a second terminal, and a control terminal, the first terminal being coupled to the first node, the second terminal being coupled to a second node, and the control terminal being coupled to a third node;

a third resistor, provided with one terminal coupled to the second node, and another terminal grounded;

a second switching device provided with a first terminal, a second terminal, and a control terminal, the first terminal being coupled to the third node, the second terminal being grounded, and the control terminal being coupled to the output terminal of the processor;

a fourth resistor, provided with one terminal coupled to a DC voltage source, and another terminal coupled to the third node; and a zener diode provided with a cathode coupled to the third node and an anode grounded.

2. The dimmer control circuit according to claim 1, wherein the input voltage detecting circuitry comprises:

a first resistor, provided with one terminal coupled to the first node, and another terminal coupled to the output terminal of the input voltage detecting circuitry; and a second resistor, provided with one terminal coupled to the output terminal of the input voltage detecting circuitry and another terminal grounded.

3. The dimmer control circuit according to claim 1, wherein the preset condition is indicative of that a changing speed of the detected voltage is greater than a first preset value.

4. The dimmer control circuit according to claim 1, wherein the preset condition is indicative of that the detection voltage has a value smaller than a second preset value.

5. The dimmer control circuit according to claim 1, wherein the processor comprises:

a voltage acquisition module, configured to acquire the detected voltage according to a preset period;

a condition determining module, configured to determine whether the detected voltage meets the preset condition; and a signal sending module, configured to send a first control signal when the detection voltage meets the preset condition, and send a second control signal when the detection voltage does not meet the preset condition.

6. The dimmer control circuit according to claim 5, wherein the constant current circuitry outputs a preset current in response to the first control signal, and stops outputting the preset current in response to the second control signal.

7. A current control method, being applied in the dimmer control circuit according to claim 1 and comprising:

detecting an output voltage of the phase cut dimmer according to a preset period;

providing compensation current to the phase cut dimmer when the output voltage of the phase cut dimmer meets the preset condition, the compensation current compensating a holding current of the phase cut dimmer; and stopping the providing of the compensation current when the output voltage of the phase cut dimmer does not meet the preset condition.

8. The current control method according to claim 7, wherein the preset condition is indicative of that a changing speed of the output voltage is greater than a first preset value.

9. The current control method according to claim 7, wherein the preset condition is indicative of that the output voltage of the phase cut dimmer has a value smaller than a second preset value.

10. The current control method according to claim 7, wherein the compensation current is a constant current, and the constant current is greater than the holding current of the phase cut dimmer.

11. A current control system, comprising the dimmer control circuit according to claim 1 and further comprising:

an AC power, provided with a first output terminal and a second output terminal;

the phase cut dimmer, provided with one terminal coupled to a first output terminal of the AC power, and another terminal coupled to a voltage output node;

a bridge rectifier diode, provided with a cathode coupled to the voltage output node, and an anode grounded;

an illumination power circuit, provided with a first input terminal, a second input terminal, a first output terminal, and a second output terminal, wherein the first input terminal is coupled to the voltage output node; and an illumination module, provided with at least one light source coupled to the first output terminal and the second output terminal of the illumination power circuit;

wherein the dimmer control circuit is coupled between the voltage output node and the ground for providing compensation current to the phase cut dimmer when an output voltage of the phase cut dimmer meets the preset condition, and stopping the providing of the compensation current when the output voltage of the phase cut dimmer does not meet the preset condition.

12. The current control system according to claim 11, wherein the preset condition is indicative of that a changing speed of the output voltage of the phase cut dimmer is greater than a first preset value.

13. The current control system according to claim 11, wherein the preset condition is indicative of that the output voltage of the phase cut dimmer has a value smaller than a second preset value.

14. The current control system according to claim 11, wherein the compensation current is a constant current, and the constant current is greater than a holding current of the phase cut dimmer.

15. The current control system according to claim 11, wherein the illumination power circuit comprises a rectifier circuitry and a DC-DC converter.

16. The current control system according to claim 11, wherein the phase cut dimmer comprises a leading-edge cut dimmer or a trailing-edge cut dimmer.

* * * * *